US006698506B1

(12) United States Patent
Barrett

(10) Patent No.: US 6,698,506 B1
(45) Date of Patent: Mar. 2, 2004

(54) FAN HOUSING HEAT EXCHANGER

(76) Inventor: Terry T. Barrett, 3030 Yarwood, El Paso, TX (US) 79935-1732

( * ) Notice: Subject to any disclaimer, the term of this patent is extended or adjusted under 35 U.S.C. 154(b) by 0 days.

(21) Appl. No.: 10/386,542

(22) Filed: Mar. 13, 2003

(51) Int. Cl.[7] ..... F28F 13/12; F24H 3/00; F24H 3/02

(52) U.S. Cl. ..... 165/122; 165/47; 126/110 R

(58) Field of Search ..... 165/47, 901, 121, 165/122, 157; 126/110 R, 116 R

(56) References Cited

U.S. PATENT DOCUMENTS 4,682,579 A * 7/1987 Bigham ..... 126/110 R
5,313,930 A * 5/1994 Kujawa et al. ..... 126/116 R
5,368,010 A * 11/1994 Weber et al. ..... 126/110 R
5,375,586 A * 12/1994 Schumacher et al. ... 126/110 R
5,379,751 A * 1/1995 Larsen et al. ..... 126/110 R
5,546,925 A * 8/1996 Knight et al. ..... 126/110 R
5,704,343 A * 1/1998 Ahn et al. ..... 126/110 R

* cited by examiner

*Primary Examiner*—Henry Bennett
*Assistant Examiner*—Tho Duong

(57) ABSTRACT

Herein presented is a unique device for air delivery and heat transfer. The housing assembly with the integrated heat exchanger chambers of the device along with a gas train assembly, a draft fan motor assembly, and a centrifugal fan assembly provides air flow to an air stream and transfer of energy to the same air stream from a combustion gas mixture stream inside the heat exchanger chambers. All the components of the debice, the heat exchanger chambers, the centrifugal fan motor assembly, the gas train assembly, and the draft fan motor assembly are housed together in a single economical unit.

1 Claim, 2 Drawing Sheets

FAN HOUSING HEAT EXCHANGER

BACKGROUND OF THE INVENTION

For eons man has attempted to control his environment. Modern man works and lives in buildings with controlled environments. Many devices for conditioning the air have become more sophisticated and complex. One device, the forced air fuel fired furnace requires a number of parts or assemblies including a separate fan section and a separate heat exchanger. The centrifugal fan takes in air parallel to its axis of rotation. It discharges the air perpendicular to its axis of rotation and forces the air past the outer surfaces of the heat exchanger chambers. The heat exchanger is made up of one or more sealed chambers that transport inside the sealed chambers combustion gases while transferring heat energy to the air passing on the outside of the chambers without mixing the air with the combustion gases.

The combining of both the fan housing and the heat exchanger into one unique compact assembly presented here is designed to provide energy transfer as well as to direct air flow. All the components of the device are made and arranged to facilitate in these tasks.

The housing of the device has five individual openings and one set of one or more openings. The remainder of the housing of the device is air sealed. The device takes in new air from the environment through the two inlets and directs it through the blades of the centrifugal fan. The new air continues past the heat exchanger chamber(s) absorbing heat from the heat exchanger and exits out of the outlet opening of the device. The gas train provides the fuel to air mixture and ignition of this mixture which enters the heat exchanger chamber (s) through the one set of one or more openings of the device. The combustion gas mixture travels inside the heat exchanger chamber(s) transferring heat to the new air that is outside the chamber(s) and then to be scavenged by the draft fan motor assembly and exhausted out through the exhaust vent pipe opening in the device. The new air from the environment and the combustion gas mixture do not mix while in the device.

SUMMARY OF THE INVENTION

The invention is a unique fan housing with an integrated heat exchanger that directs air flow through the device and provides heat transfer from the combustion gas mixture to the new air from the environment. The combustion gas mixture and new air never make contact with each other in the device.

BRIEF DESCRIPTION OF THE DRAWINGS

The invention can be better understood by examining the following in connection with the accompanying drawings towit.

DESCRIPTION OF THE PREFERRED EMBODIMENTS

Figure 1:
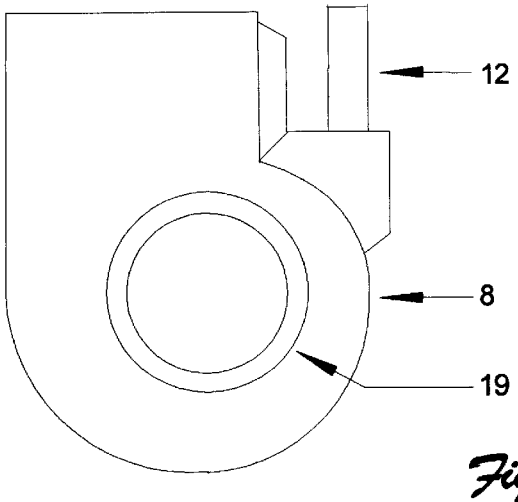
FIG. 1 is a plain side view of the fan housing heat exchanger device that has an entrance opening.
Figure 2:
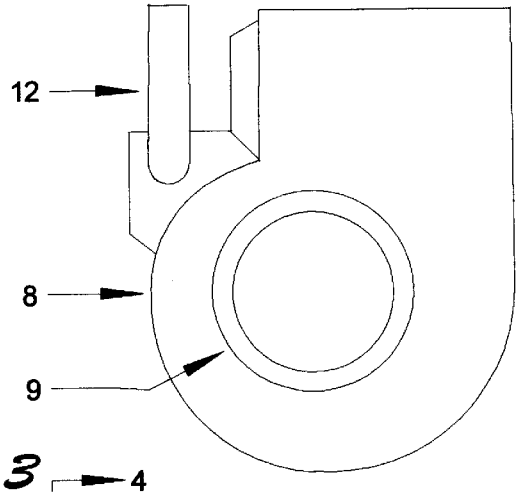
FIG. 2 is a plain opposite side view of the fan housing heat exchanger device that has another entrance opening.
Figure 3:
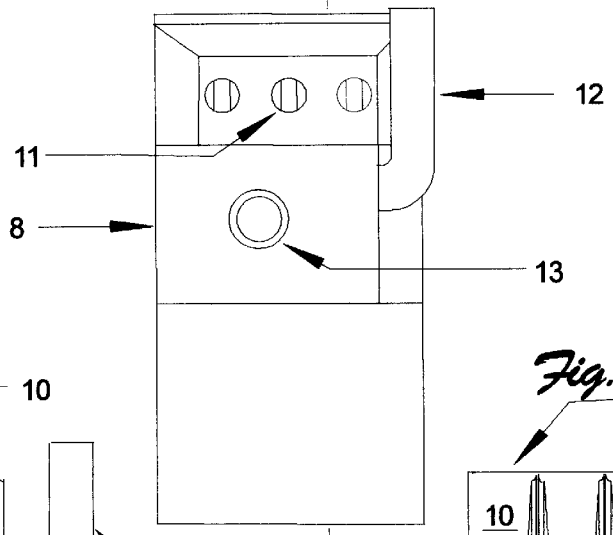
FIG. 3 is a plain front view of the fan housing heat exchanger device that has one set of one or more combustion gas inlet openings and one opening for the draft motor assembly to mount over.
Figure 4:
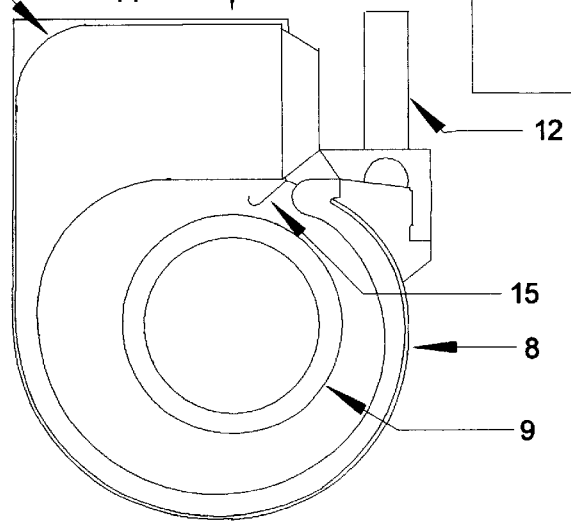
FIG. 4 is a sectional side view of the fan housing heat exchanger device.
Figure 5:
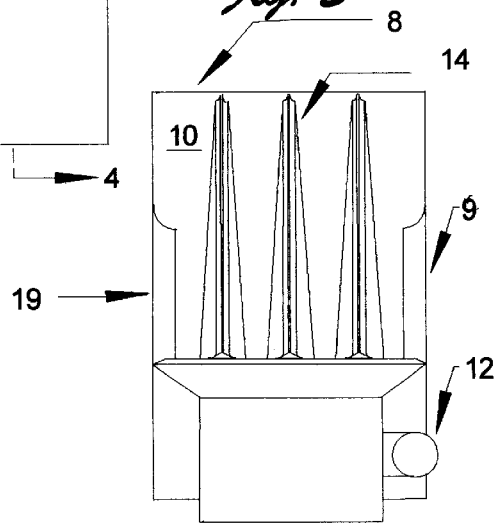
FIG. 5 is a plain top view of the fan housing heat exchanger device with the air outlet opening and the combustion gas exhaust pipe opening.
Figure 6:
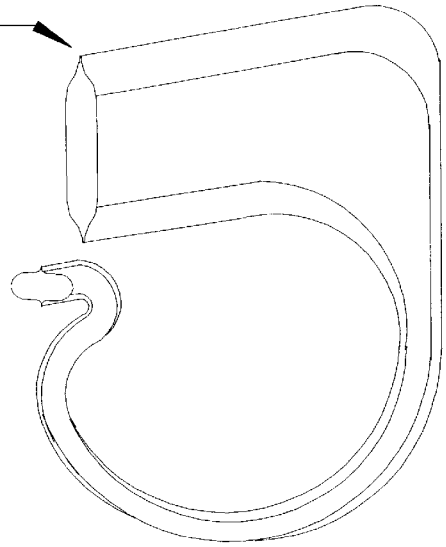
FIG. 6 is an isometric view of one of the heat exchanger chambers from the fan housing heat exchanger device.
Figure 7:
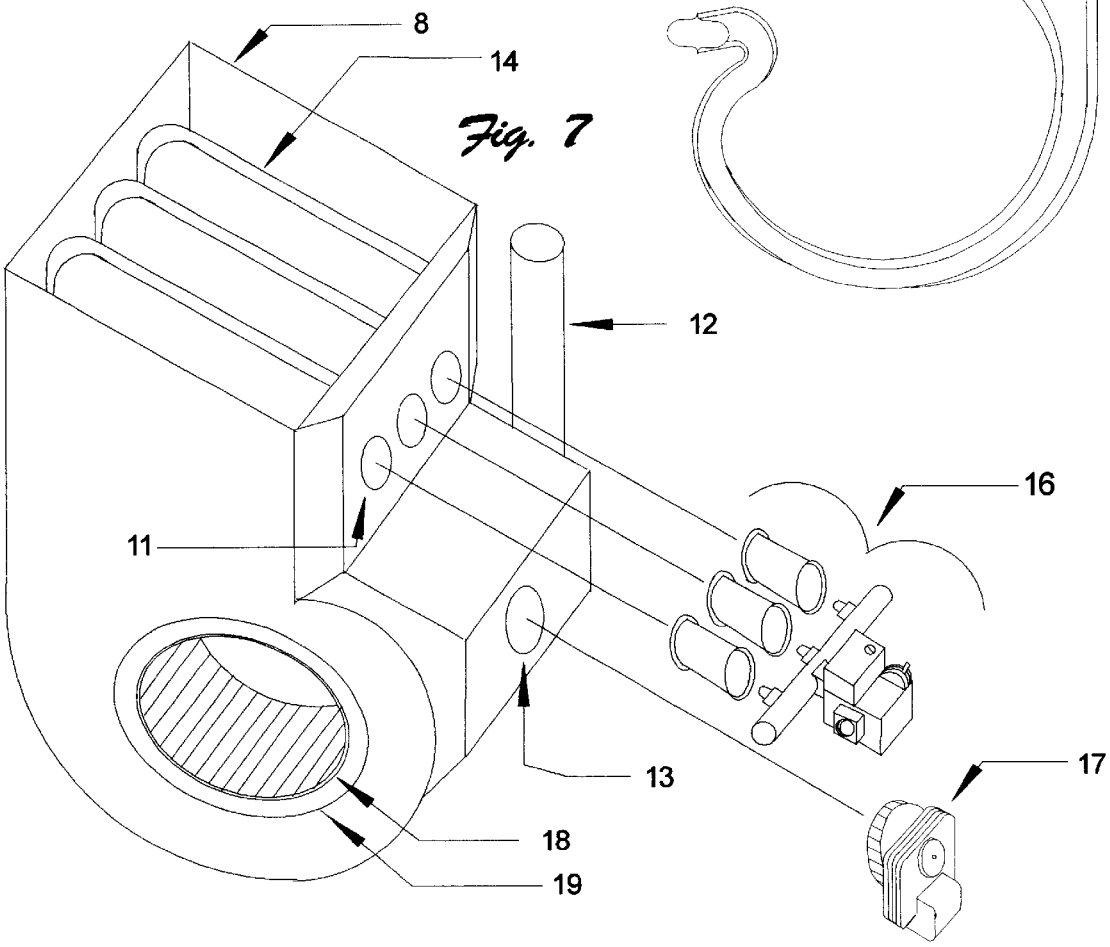
FIG. 7 is an isometric view of the fan housing heat exchanger device with the centrifugal fan motor assembly, gas train assembly, and draft motor assembly represented.

Referring now to the drawings and the preferred embodiments of the invention. FIG. 1 shows one side of the device that has an opening (8) for air to enter the device, the combustion gas exhaust pipe (12), and the outer housing (7). FIG. 2 shows the opposite side of the device that has an opening (9) for air to enter the device, the combustion gas exhaust pipe (12), and the outer housing (7). FIG. 3 shows the front of the outer housing (7) of the device, the set of inlet openings for the combustion gas mixture (11), the combustion gas exhaust pipe (12), the draft motor assembly mount opening (13), and sectional reference (4) to FIG. 4. FIG. 4 is a sectional side view of the device which shows the outer housing (7), the air inlet opening (9), the opening (10) to exit the air from the device, the draft motor assembly mount opening (13), the heat exchanger chamber (14) and the air cut-off (15). FIG. 5 shows the plain top view of the device that has the housing (7), the air inlet openings (8) and (9) with the air exiting out of opening (10), the combustion gas mixture exhaust pipe opening (12), and the heat exchanger chambers (14). FIG. 7 is an isometric view of the housing (7) with the inlet opening (8) and representative centrifugal wheel (18) in place, the set of combustion gas inlet openings (11) with representative gas train (16) shown for placement, combustion gas exhaust pipe (12), draft fan motor mount location (13) with representative draft motor assembly (17) shown for placement, and heat exchanger chambers (14) in place.

What is claimed is:

1. A set of one or more heat conductive heat exchanger chambers integrated into a centrifugal fan housing device that directs the air stream past the said heat exchanger chambers which supports the transfer of energy from the combustion gas mixture inside the said heat exchanger chambers to the air stream outside the said heat exchanger chambers arranged in this fashion: Air tight housing except for five individual openings and one set of one or more openings in said housing, a first circular opening in one side of said device also for the intake of air, a second circular opening in a second side of the said device also for the intake of air, a separate opening in the top of the said housing for the exit of the air, a set of one or more said heat exchanger chambers with the inlet of said heat exchanger chambers affixed to the set of one or more openings of the combustion gas mixture inlet on the front of the said housing and with the outlet of said heat exchanger to the inside of the draft fan motor mount opening on the front of said housing, ax said set of one or more openings on the front of the said device for the inlet of the said combustion gas mixture supplied by a gas train assembly, a separate combustion gas exhaust pipe opening on the top of the said device for the exhaust of the said combustion gas mixture, and said mount opening for a draft fan motor assembly to scavenge the said combustion gas mixture from the said heat exchanger chambers and exhaust the said combustion gas mixture out through the combustion gas mixture exhaust pipe.

* * * * *